US006244558B1

(12) United States Patent
Castle

(10) Patent No.: US 6,244,558 B1
(45) Date of Patent: Jun. 12, 2001

(54) MOUNTING DEVICE OR CATCH

(76) Inventor: Richard A. Castle, 2943 - 29th Ave. NW., Olympia, WA (US) 98502

( * ) Notice: Subject to any disclaimer, the term of this patent is extended or adjusted under 35 U.S.C. 154(b) by 0 days.

(21) Appl. No.: 09/502,181

(22) Filed: Feb. 10, 2000

Related U.S. Application Data

(60) Provisional application No. 60/120,421, filed on Feb. 16, 1999.

(51) Int. Cl.[7] ..... A01K 97/10

(52) U.S. Cl. ..... 248/544; 248/475.1; 248/494; 248/903

(58) Field of Search ..... 248/544, 903, 248/490, 494, 475.1, 488

(56) References Cited

U.S. PATENT DOCUMENTS

| | | | | |
|---|---|---|---|---|
| 4,340,199 | | 7/1982 | Brock | 248/544 |
| 4,394,000 | * | 7/1983 | Kurtz | 248/466 |
| 4,436,269 | | 3/1984 | Dirksing et al. | 248/214 |
| 4,444,371 | | 4/1984 | Ragen | 248/225.31 |
| 4,489,993 | | 12/1984 | Hasegawa et al. | 312/7.2 |
| 4,524,938 | | 6/1985 | Strahs et al. | 248/110 |
| 4,524,941 | | 6/1985 | Wood et al. | 248/544 |
| 4,565,465 | | 1/1986 | Oberst | 403/407.1 |
| 4,679,709 | | 7/1987 | Poitras et al. | 222/180 |
| 4,717,195 | | 1/1988 | Okuyama et al. | 296/72 |
| 4,763,545 | | 8/1988 | Spease | 74/501 R |
| 5,295,651 | | 3/1994 | Baker, Jr. | 248/488 |
| 5,367,803 | | 11/1994 | Albin | 40/152.1 |
| 5,425,524 | | 6/1995 | Messina, Jr. | 248/475.1 |
| 5,584,462 | | 12/1996 | Reese | 248/477 |
| 5,829,723 | | 11/1998 | Brunner et al. | 248/222.13 |
| 6,053,468 | * | 4/2000 | Francis | 248/475.1 |

* cited by examiner

*Primary Examiner*—Ramon O. Ramirez
(74) *Attorney, Agent, or Firm*—Garrison & Associates PS; David L. Garrison

(57) ABSTRACT

The present invention describes an improved mounting device or catch intended for mounting mirrors, glass plates or other generally flat objects to walls, doors, cabinets or other appropriate surfaces. The present invention comprises a plastic shell element, similar in appearance to existing mounting devices, but having a recessed means on its back side to accommodate a support plate. The support plate is a preferably metal, generally J-shaped plate that slidably engages the plastic shell to provide much greater structural integrity to the mounting device. In addition to strengthening the basic support structure, the metal plate provides a secondary support means that can retain the supported object even in the event of a failure of the plastic shell, potentially preventing the destruction of the supported object. The improved structural features are accomplished while retaining the aesthetic features and resilient support features of prior-art plastic mounting devices.

6 Claims, 3 Drawing Sheets

MOUNTING DEVICE OR CATCH

This application claims the benefit of U.S. Provisional Patent Application Serial No. 60/120,421, filed Feb. 16, 1999 and entitled Mounting Device or Catch.

FIELD OF INVENTION

The present invention relates to a mounting device or catch and specifically to a mounting device or catch for objects such as mirrors, unframed pictures covered with a sheet of glass, or other generally flat objects. These devices can be used for mounting such objects, for example, on walls, doors, cabinets or the like, and also on boxes which are provided with hinged lids.

BACKGROUND OF THE INVENTION

The object of the invention is to improve such mounting devices or catches so as to expand their usefulness and make their operation more secure. In particular the present invention addresses the problem of a high in-service failure rate experienced for this type of mounting device.

Mirrors and other glass sheets are heavy, hard, and frequently have sharp rectangular edges. Devices similar to the present invention are commonly used for hanging mirrors and other glass sheets to walls, doors, cabinets and other flat surfaces. This family of hangers are typically made from hard plastics, which are aesthetically pleasing, inexpensive to fabricate and soft and resilient enough to preclude damaging the mirror or glass sheet. For example, U.S. Pat. No. 5,295,651 teaches a plastic mirror mounting clip similar to the present invention, with a slidable mounting configuration. Also, U.S. Pat. No. 4,340,199 teaches a similar hanger having two pieces that are slidably connected.

In-service failures of these types of mounting devices have been experienced whereby the vertical lip and/or horizontal flanges break, allowing the mirror, glass sheet or other flat object to fall with predictable catastrophic results. This failure mode is a result of the weight of the glass impacting the plastic mounting devices. The local forces on the plastic clips may be further magnified during installation by the speed of the vertical movement when placing the glass sheet on the lower clips, and by the relatively sharp edges of glass sheets, which may concentrate the forces on the clip.

Mirrors and other glass sheets are virtually ubiquitous in American homes, and the number of in-service mounting devices therefore number in the hundreds of millions. Therefore any reduction in the failure rate for these devices will have a significant aggregate economic impact. For the foregoing reasons, there is a need for an inexpensive mounting clip with improved strength that will support heavy objects such as mirrors and glass plates without breaking.

SUMMARY OF THE INVENTION

Accordingly, it is an object of the present invention to provide a mounting clip for mounting mirrors and other flat objects that will better withstand the stresses of supporting heavy, hard objects, and will experience fewer in-service failures.

It is a further object of the present invention to provide a mounting clip that will provide a secondary support means such that damage to the supported object will be mitigated even in the event of certain modes of failure of the mounting device.

It is a further object of the present invention to provide such mounting clips that retain the aesthetic characteristics of prior mounting devices.

It is a further object of the present invention to provide such mounting clips that are reasonably inexpensive.

It is a further object of the present invention to provide such mounting clips that are not significantly more difficult to install than prior mounting clips.

The present invention is intended to function as the lower, weight-supporting clips, in concert with conventional mounting clips on the upper end of the glass sheet. The present invention achieves its superior structural characteristics by the use of a metal insert designed to fit cooperatively with a plastic shell similar to existing, prior-art mounting devices.

These and such other objects of the invention as will become evident from the disclosure below are met by the invention disclosed herein. In addition to the explicitly claimed apparatus described herein, it is to be understood that all new and useful devices or components described herein are considered to constitute a part of the invention, claimable in their own right, whether such is stated with particularity herein or not.

BEST MODE OF CARRYING OUT THE INVENTION

Figure 1:
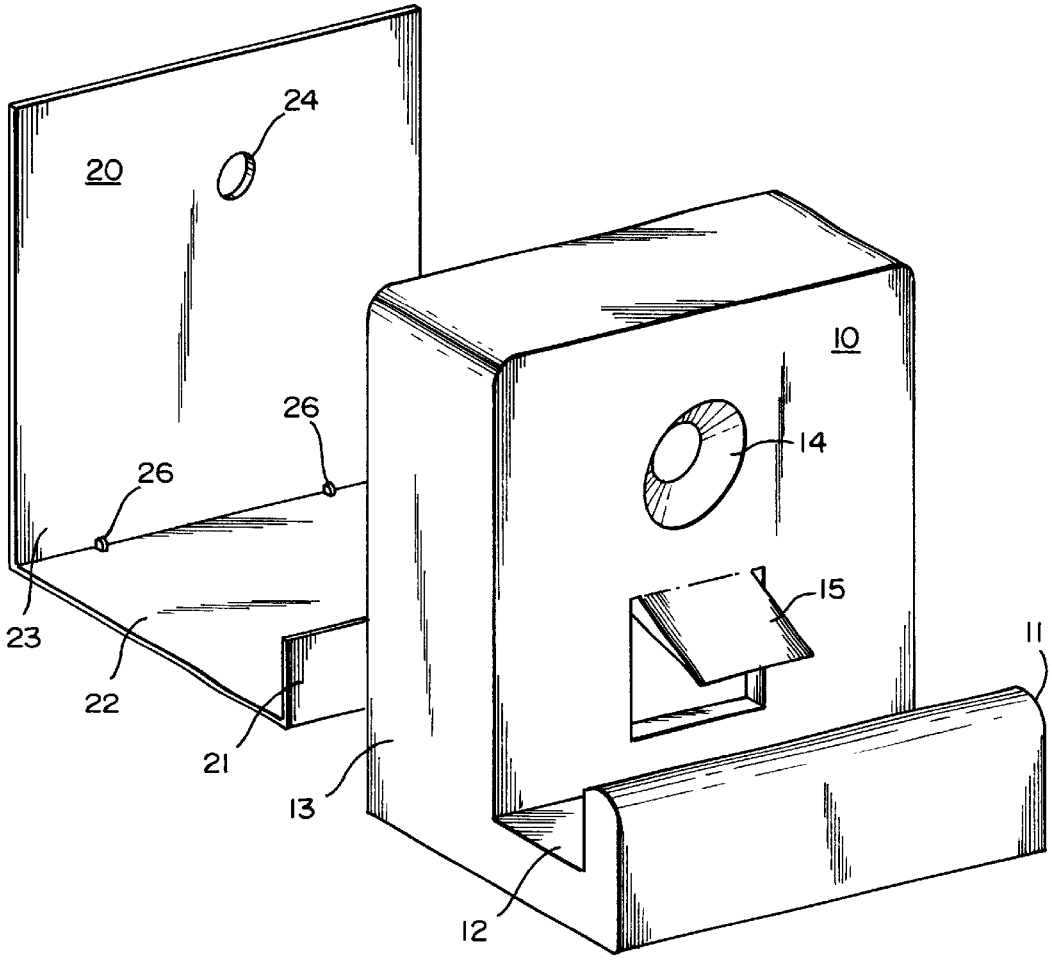
FIG. 1 is a perspective exploded view of the mounting device or catch of the present invention.

Turning now to the drawings, the invention will be described in a preferred embodiment by reference to the numerals of the drawing figures.

In the preferred embodiment the mounting device provides a structurally improved two-piece supporting clip that is aesthetically very similar to existing mounting devices. The first piece is a plastic shell 10 having external support-side contours that are similar to prior-art mounting devices. The plastic shell 10 has a base portion 13 having a recessed hole 14 along its centerline to accommodate an attachment means such as a screw for attaching the device to a wall, door or other surface. A hook portion 12 depends vertically from the lower edge of the base portion 13, providing a generally horizontal surface for supporting a mirror, glass plate or other similar object. An integral lip 11 depends vertically from the end of the hook portion 12 farthest from the base portion 13. The base portion l3 and hook portion 12 with integral lip 11 provide a generally J-shaped hook for supporting and retaining any flat object. The base portion includes a resilient tongue 15, preferably formed as an integral part of the shell 10 and depending at an angle from approximately the center of the shell 10 towards the lip 11, to provide a spring-like means for holding the flat object against the lip thereby preventing any rattling or undesirable lateral movement of the flat object.

Figure 4:
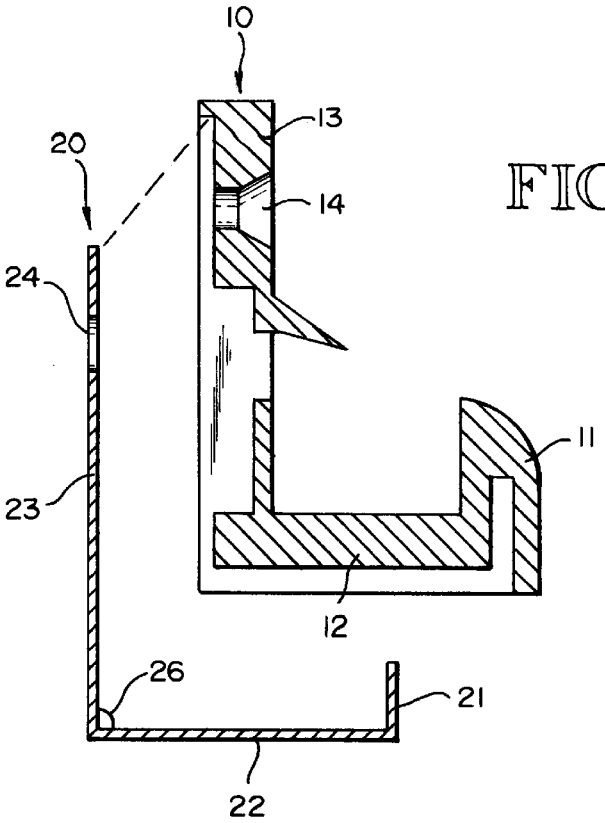
FIG. 4 is an exploded sectional view of the plastic shell and metal support plate comprising the present invention.
Figure 5:
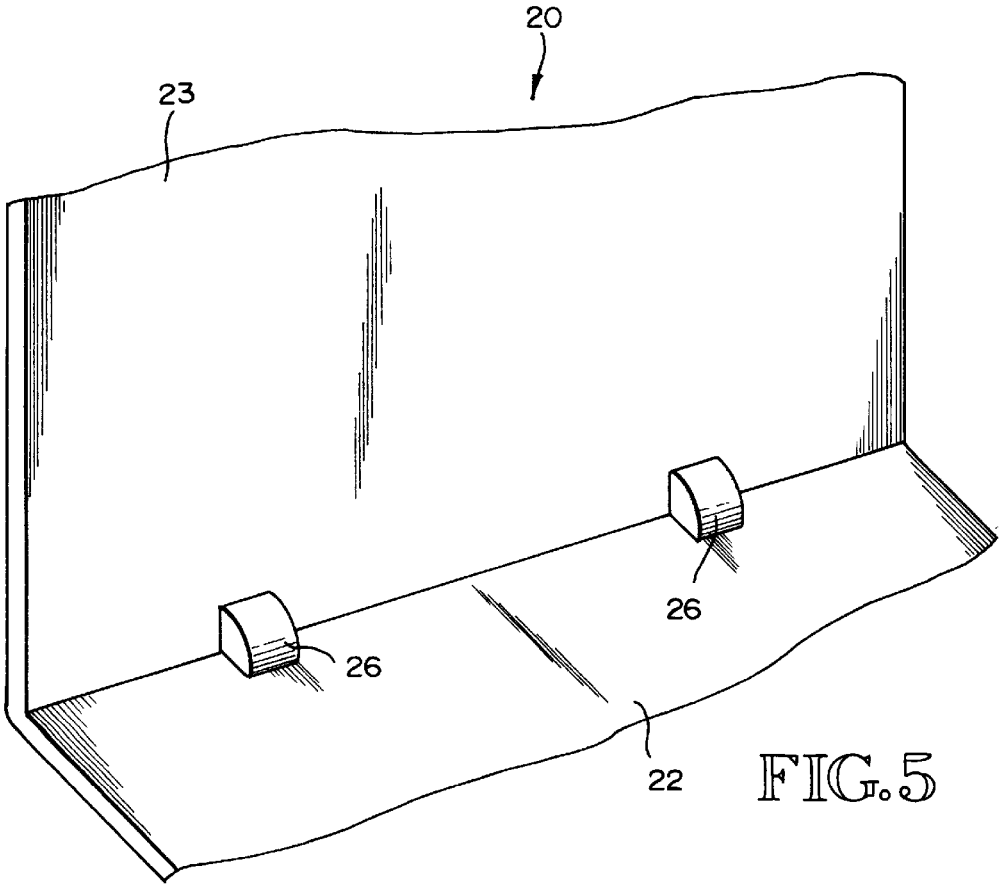
FIG. 5 is a fragmentary perspective view of the support plate showing the crimp applied to stabilize the bend in the support plate.

In the preferred embodiment, the back side of the shell 10 is fabricated to have a recessed area generally along the entire back side of the shell 10. As can best be seen in FIG. 4, the recessed portion preferably culminates on the lip-end with a rectangular channel protruding into the lip 11 portion of the shell, generally along the center-plane of the lip 11 portion.

The second piece of the mounting device is a metal support plate 20 preferably stainless steel formed from a single generally rectangular piece of metal. In the preferred embodiment the support plate 20 is made from quarter-hardened stainless steel. The support plate 20 has a back portion 23 sized to fit into the recess on the back portion 13 of the shell 10, and has a hole 24 located along its centerline and positioned such that when the support plate back portion 23 is inserted into the back portion 13 of the shell 10 the hole 24 is aligned with the recessed hole 14 in the shell 10. A hook portion 22 depends perpendicularly from the lower end of the back portion 23 of the support plate 20, and is sized to fit into the recess on the bottom of the hook portion 12 of the shell 10. In the preferred embodiment the hook portion 22 is formed by bending the stainless steel plate approximately ninety degrees and applying a crimp 26 to the metal in at least one location along the bend. The crimp or crimps 26 significantly increase the strength and stability of the support plate 20. An integral lip 21 depends vertically from the end of the hook portion 22 of the back plate 20, and is sized to slidably fit into the rectangular channel protruding into the lip 11 of the shell 10. The lip 21 is preferably formed by bending the hook portion 22. As can best be seen in FIG. 4, in this embodiment the support plate 20 may be slidably inserted into the plastic shell 10 by positioning the support plate 20 below the shell 10 with the lip 21 portion of the support plate 20 aligned with the rectangular channel in the lip 11 portion of the shell and sliding the support plate 20 vertically into the shell 10.

The support plate 20 strengthens the hook portion 12 and integral lip 11 of the shell 10, which is a common point of failure for prior art mounting devices. In addition, the back portion 23 of the support plate 20 reinforces the mounting device at the location of attachment to the wall, door or other surface.

It is particularly beneficial that the metal support plate 20 provides a secondary means of retaining the supported mirror, glass plate or other object even if the shell 10 experiences a failure. In prior art mounting devices a failure of the device will inevitably result in the supported object falling from its mounting position, with generally predictable catastrophic results to the supported object. In the present invention, if the shell 10 cracks or breaks into multiple pieces, the metal support plate 20 will continue to support the object with no damage, or minimal damage, until the supporting device can be repaired or replaced.

Figure 2:
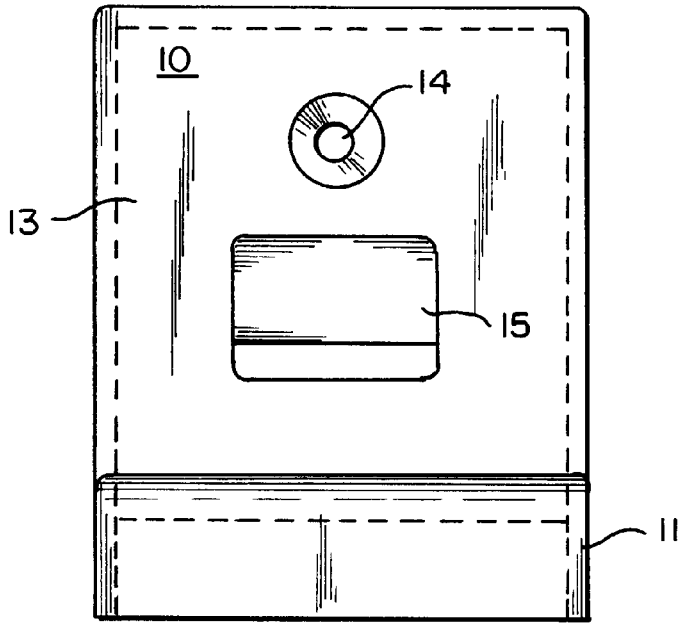
FIG. 2 is a front view of the assembled mounting device or catch of the present invention.
Figure 3:
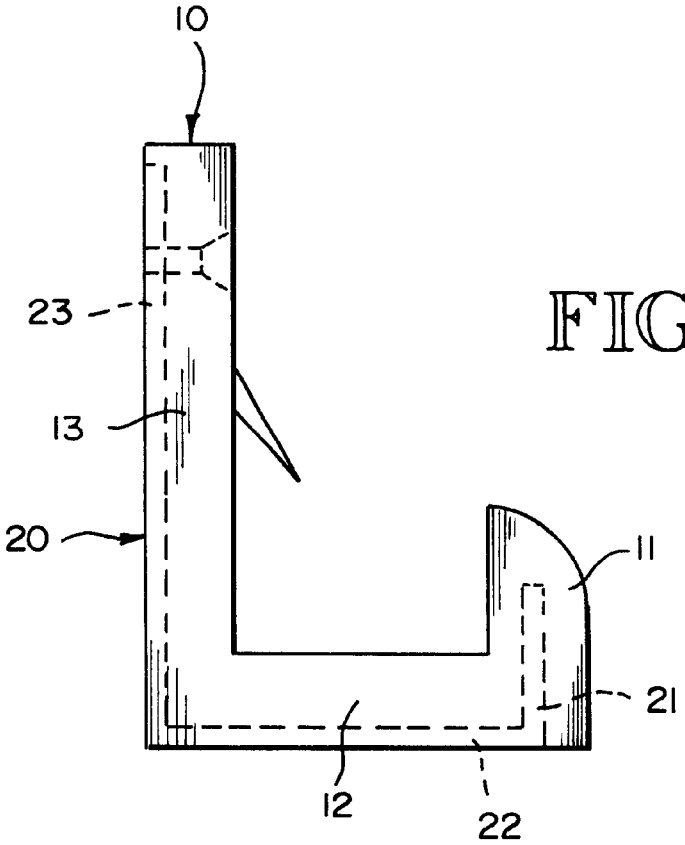
FIG. 3 is a side view of the assembled mounting device or catch of the present invention.

It is also noted that the aesthetic and resilient support features of prior-art plastic mounting devices are retained in the present invention. As can best be seen in FIGS. 2 and 3, the metal support plate 20 is not directly visible from the front or side view of the mounting device. Moreover, the plastic shell 10 is the only part of the present mounting device that contacts the supported object. Therefore the present invention retains the feature of prior-art devices, resisting scratching or other damage to the supported devices.

It will be obvious to one of ordinary skill in the art that an alternative embodiment may be produced having many of the advantages of the preferred embodiment described above, wherein the metal support plate 20 is embedded into an integral plastic shell (not shown).

In compliance with the statute, the invention has been described in language more or less specific as to structural features. It is to be understood, however, that the invention is not limited to the specific features shown, since the means and construction shown comprise preferred forms of putting the invention into effect. The invention is, therefor, claimed in any of its forms or modifications within the legitimate and valid scope of the appended claims, appropriately interpreted in accordance with the doctrine of equivalents.

I claim:

1. A mounting device comprising:

i. a plastic shell having a front side and a back side, said plastic shell having a recess on said back side, and said plastic shell comprising a back plate having a hook portion extending forwardly from said front side from one edge of said back plate, said hook portion having an integral lip portion extending from said hook portion approximately parallel to said base plate such that said plastic shell is generally J-shaped, and said lip portion having a rectangular channel extending partially therethrough; and ii. a metal support plate having a generally J-shape and sized to slidably fit into said recess on the back side of said plastic shell, and into said rectangular channel in the lip portion of said plastic shell.

2. The mounting device or catch of claim 1 wherein said back plate of said plastic shell further comprises a resilient tongue protruding forwardly from said back plate.

3. The mounting device or catch of claim 1 wherein said back plate further comprises a recessed hole therethrough to accommodate a fastening means for attachment to an external surface, and wherein said metal support plate further comprising a hole therethrough located such that said hole is aligned with said recessed hole when said support plate is slidably inserted into said plastic shell.

4. The mounting device or catch of claim 1 wherein said metal support plate is made from a single piece of quarter-hardened stainless steel.

5. The mounting device of claim 1 wherein said metal support plate comprises of a single piece of quarter-hardened stainless steel having two approximately ninety degree bends therein to form said J-shape and wherein at least one of said ninety degree bends has at least one crimp therein.

6. A mounting device comprising:

i. a metal support plate comprising a first vertical portion, a horizontal portion and a second vertical portion, said vertical and horizontal portion forming a generally J-shape;.

ii. a plastic shell encasing said metal support plate, said plastic shell comprising a vertical base plate covering said first vertical portion of said metal support plate, and an integral hook portion extending horizontally therefrom, covering said horizontal portion and said second vertical portion of said metal support plate.

* * * * *